US008678189B2

(12) United States Patent
Niggel et al.

(10) Patent No.: US 8,678,189 B2
(45) Date of Patent: Mar. 25, 2014

(54) BOX TYPE CONTAINER HOLDER FOR MEDICATION CARDS

(71) Applicant: Berlin Packaging, LLC, Chicago, IL (US)

(72) Inventors: Brett Niggel, St. Corry, PA (US); Liam Hawry, Chicago, IL (US); Scott Jost, Glen Ellyn, IL (US)

(73) Assignee: Berlin Packaging, LLC, Chicago, IL (US)

( * ) Notice: Subject to any disclaimer, the term of this patent is extended or adjusted under 35 U.S.C. 154(b) by 0 days.

(21) Appl. No.: 13/666,053

(22) Filed: Nov. 1, 2012

(65) Prior Publication Data

US 2013/0112587 A1 May 9, 2013

Related U.S. Application Data

(60) Provisional application No. 61/555,059, filed on Nov. 3, 2011.

(51) Int. Cl.
*B65D 1/09* (2006.01)
*B65D 41/18* (2006.01)
*B65D 43/04* (2006.01)

(52) U.S. Cl.
USPC ..... 206/528; 220/784; 220/801

(58) Field of Classification Search
USPC ..... 206/528, 531, 535, 828, 536, 242; 220/326, 784, 788–791, 4.23, 839, 220/801–804, 916
See application file for complete search history.

(56) References Cited

U.S. PATENT DOCUMENTS

| | | | | | |
|---|---|---|---|---|---|
| 2,366,886 | A | | 1/1945 | Van Tuyl | |
| 2,617,578 | A | * | 11/1952 | Fischer | 206/214 |
| 3,172,530 | A | * | 3/1965 | Grabosky et al. | 206/747 |
| 3,504,788 | A | | 4/1970 | Gray | |
| 3,552,595 | A | | 1/1971 | Gerner | |
| 3,579,883 | A | | 5/1971 | Hayes | |
| 3,630,171 | A | | 12/1971 | Huck | |
| 3,737,029 | A | | 6/1973 | Serrell et al. | |
| 4,125,190 | A | | 11/1978 | Davie, Jr. et al. | |
| 4,262,607 | A | * | 4/1981 | Krebs | 109/58 |
| 4,340,141 | A | | 7/1982 | Fischer | |
| 4,365,711 | A | * | 12/1982 | Long et al. | 206/387.13 |
| 4,444,308 | A | * | 4/1984 | MacEwen | 206/249 |
| 4,955,481 | A | | 9/1990 | Noviaski et al. | |
| 4,974,729 | A | | 12/1990 | Steinnagel | |
| 5,050,739 | A | | 9/1991 | Hannan et al. | |
| 5,109,984 | A | | 5/1992 | Romick | |
| 5,265,728 | A | | 11/1993 | Allendorf et al. | |
| 5,323,907 | A | | 6/1994 | Kalvelage | |
| 5,351,818 | A | | 10/1994 | Daneshvar | |
| 5,549,204 | A | | 8/1996 | Toren | |
| 5,671,856 | A | * | 9/1997 | Lisch | 220/4.27 |

(Continued)

*Primary Examiner* — J. Gregory Pickett
*Assistant Examiner* — Jennifer N Zettl
(74) *Attorney, Agent, or Firm* — Adam K. Sacharoff

(57) ABSTRACT

There is shown in a pill blister pack container for holding a pill blister pack. The container having a central structure with a hollowed interior configured to hold the blister pack. A top is secured to the central structure by a hinge member and has a closure structure secured configured to maintain the top in a closed portioned. The closure structure includes corresponding first locking members formed on forward facing surfaces to cooperate in maintaining the cap in the closed position along with corresponding second locking members formed on side facing surfaces and formed on the top to further maintain the cap in the closed positioned.

9 Claims, 5 Drawing Sheets

(56) References Cited

U.S. PATENT DOCUMENTS

| | | | | |
|---|---|---|---|---|
| 5,954,202 | A | 9/1999 | Mellon | |
| 5,979,694 | A * | 11/1999 | Bennett et al. | 220/613 |
| 6,082,572 | A * | 7/2000 | Galton-Fenzi et al. | 220/315 |
| 6,244,462 | B1 | 6/2001 | Ehrensvard et al. | |
| 6,253,920 | B1 | 7/2001 | Kallgren | |
| 6,293,403 | B1 | 9/2001 | Holmberg | |
| 6,338,408 | B1 | 1/2002 | Anderson | |
| 6,394,275 | B1 | 5/2002 | Paliotta et al. | |
| 6,659,272 | B2 * | 12/2003 | Bellin et al. | 206/232 |
| 6,679,381 | B1 | 1/2004 | Bush | |
| 6,913,149 | B2 | 7/2005 | Gelardi et al. | |
| 6,951,292 | B2 * | 10/2005 | Bando et al. | 220/254.5 |
| 7,025,207 | B2 | 4/2006 | Breu et al. | |
| 7,093,736 | B2 | 8/2006 | Maietta et al. | |
| 7,150,355 | B2 | 12/2006 | Coe et al. | |
| 7,287,660 | B2 * | 10/2007 | Ramirez et al. | 220/4.23 |
| 7,303,116 | B2 * | 12/2007 | Cervera Cunill | 229/125.37 |
| 7,419,056 | B2 | 9/2008 | Gattefosse et al. | |
| RE40,612 | E | 12/2008 | Paliotta et al. | |
| 7,464,818 | B2 | 12/2008 | Gherdan et al. | |
| 7,464,819 | B2 | 12/2008 | Maietta | |
| 7,607,538 | B2 | 10/2009 | Silvenis et al. | |
| 7,607,541 | B2 * | 10/2009 | Girgis et al. | 206/570 |
| 7,661,534 | B2 * | 2/2010 | Saclier et al. | 206/535 |
| 7,988,088 | B2 * | 8/2011 | Konstantinovskiy | 244/12.6 |
| 8,042,685 | B2 * | 10/2011 | Bourgoin et al. | 206/267 |
| 8,069,981 | B2 * | 12/2011 | Buse | 206/273 |
| 8,070,549 | B2 * | 12/2011 | King | 446/71 |
| 8,136,662 | B2 * | 3/2012 | Aeschlimann | 206/268 |
| 8,157,087 | B2 * | 4/2012 | Tanbo et al. | 206/268 |
| 8,251,252 | B2 * | 8/2012 | Giraud | 220/835 |
| 8,281,922 | B2 * | 10/2012 | Chatelain | 206/267 |
| 8,333,296 | B1 * | 12/2012 | Fung | 220/592.17 |
| 8,365,916 | B2 * | 2/2013 | Gelardi | 206/531 |
| 8,413,806 | B2 * | 4/2013 | Holford | 206/268 |
| 8,418,846 | B2 * | 4/2013 | Tanbo | 206/268 |
| 8,418,871 | B1 * | 4/2013 | LaMasney | 220/324 |
| 8,459,459 | B2 * | 6/2013 | Noble et al. | 206/538 |
| 8,469,212 | B2 * | 6/2013 | Goto et al. | 215/237 |
| 8,485,355 | B2 * | 7/2013 | England | 206/259 |
| 2002/0166792 | A1 | 11/2002 | Filion et al. | |
| 2004/0026293 | A1 | 2/2004 | Hughes | |
| 2004/0050748 | A1 | 3/2004 | Ehrlund | |
| 2004/0108240 | A1 | 6/2004 | Ragot | |
| 2005/0173291 | A1 | 8/2005 | Specker et al. | |
| 2006/0051457 | A1 | 3/2006 | Bougoulas et al. | |
| 2007/0138049 | A1 | 6/2007 | Bitner | |
| 2007/0227931 | A1 | 10/2007 | Shane | |
| 2008/0017542 | A1 | 1/2008 | Le et al. | |
| 2008/0202972 | A1 | 8/2008 | Prud'Homme | |
| 2008/0265011 | A1 | 10/2008 | Specker | |
| 2009/0084801 | A1 | 4/2009 | Cow | |
| 2009/0166244 | A1 | 7/2009 | Seymour | |
| 2009/0184023 | A1 | 7/2009 | Brollier et al. | |
| 2010/0012544 | A1 | 1/2010 | Paliotta et al. | |
| 2013/0112586 | A1 * | 5/2013 | Hawry et al. | 206/528 |
| 2013/0112588 | A1 * | 5/2013 | Flood et al. | 206/531 |

* cited by examiner

BOX TYPE CONTAINER HOLDER FOR MEDICATION CARDS

CROSS REFERENCE APPLICATIONS

The present invention is a nonprovisional application of U.S. application Ser. No. 61/555,059 filed Nov. 3, 2011, the contents of which are incorporated herein by reference.

FIELD OF THE INVENTION

The present invention relates to various medicine or pill containers.

BACKGROUND OF THE INVENTION

There are various pill dispensers available in the marketplace and the need to provide improvements and different types exist as well. There is thus disclosed herein one or more embodiments directed to holding pills and/or pill blister packs.

SUMMARY OF THE INVENTION

In one embodiment of the present invention there is provided a pill blister pack container for holding a pill blister pack. The container includes a central structure having an upper portion and a lower portion, a continuous walled surface extending from the lower portion to the upper portion to form a hollowed interior there between. The interior being configured to hold the blister pack. The container includes both a top and a bottom. The top is secured to the upper portion of the central structure by a hinge member. A closure structure is provided to help secure the top to the upper portion of the central structure in order to maintain the top in a closed portioned. The closure structure includes a pair of skirts depending upwardly from the upper portion and being separately positioned on either side of the walled surface such that one of the pair of skirts is at a distal end with respect to the other skirt. Each skirt has a forward facing surface, a rearward facing surface and a side facing surface connecting the forward and rearward facing surfaces. The closure structure and top include corresponding first locking members formed on the forward facing surfaces and formed on the top cooperating to maintain the cap in the closed position and corresponding second locking members formed on the side facing surfaces and formed on the top further cooperating to maintain the cap in the closed positioned.

The top may also be defined with a top surface having downwardly engaging walls forming a front facing wall, a rear facing wall, and a pair of side walls. As such the first locking members may include a detent on the forward facing surfaces corresponding to a indent on the front facing wall. In addition, the second locking members may include a lateral flange inwardly extending from each of the side facing surfaces, the lateral flanges corresponding to and configured to engage locking tabs extending downwardly from the top surface, each locking tabs includes an outwardly turned lip configured to engage the inwardly extending lateral flange.

In other aspects, the cap may further include a pair of channels positioned along a portion of the top surface and extending down a portion of the side walls. The pair of channels being separately formed on either side of each locking tab, and the locking tabs being connected to the top surface between the pair of channels by a bowed thinned walled section configured to flex when an exterior force is applied inwardly on the locking tabs, such that the lip on the locking tabs disengages the inwardly extending lateral flange. In yet other aspects an intermediate flange may be provided. The intermediate flange may extend downwardly from a inwardly extending lateral flange and being positioned between a terminal free edge of the inwardly extending lateral flange and the side facing surface.

In yet other embodiments, the bottom of the container may be designed to have a plug portion configured to insert within the bottom portion of the hollowed interior of the central structure, and include a base having a ramp structure and an edge hingedly attached to an edge of the plug portion, such that the base may be inserted into the plug portion with the ramp structure being positioned in the hollowed interior of the central structure.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
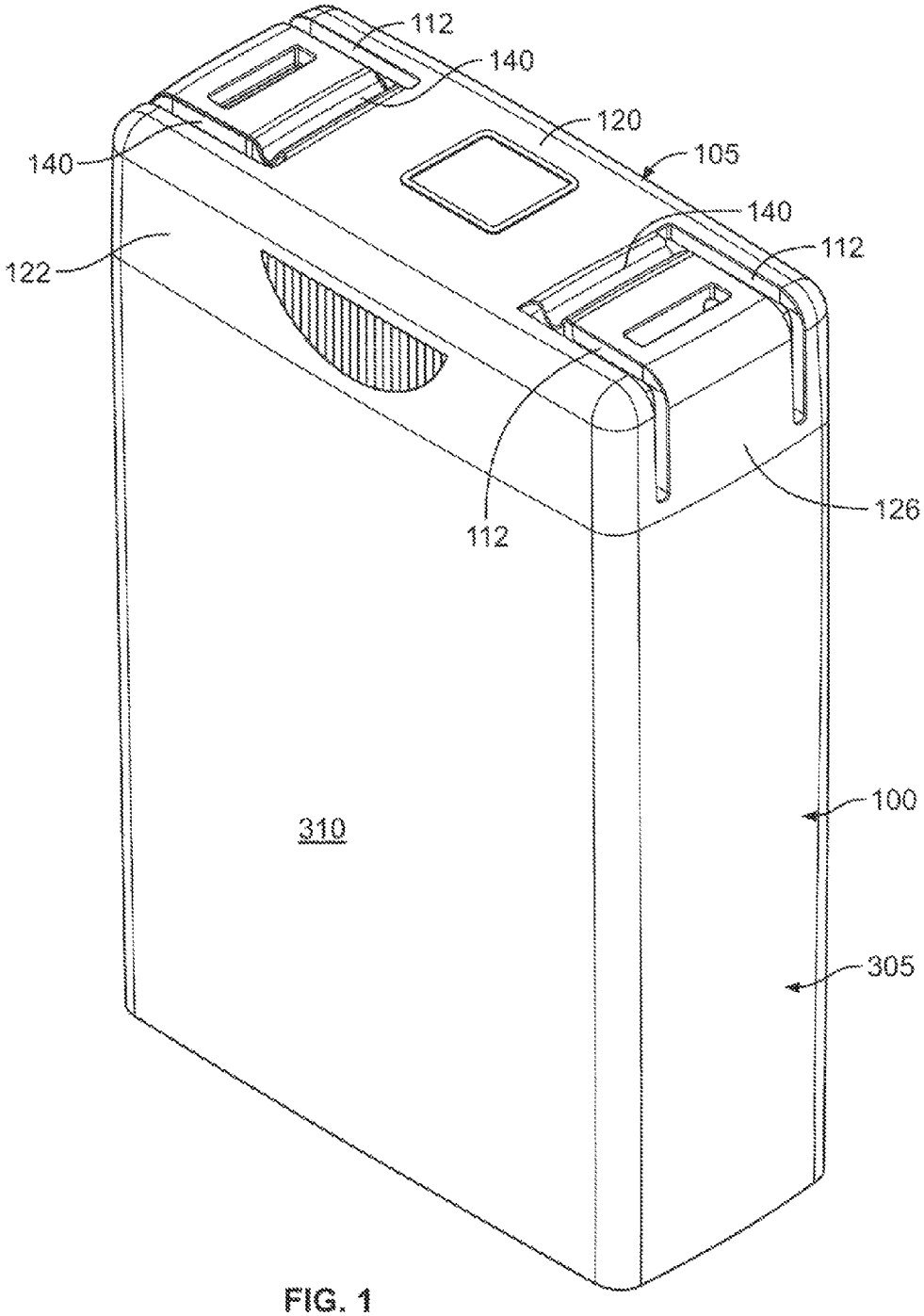
FIG. 1 is a perspective view of a container for medication blister cards in accordance with one embodiment of the present invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention of the embodiments illustrated.

Figure 2:
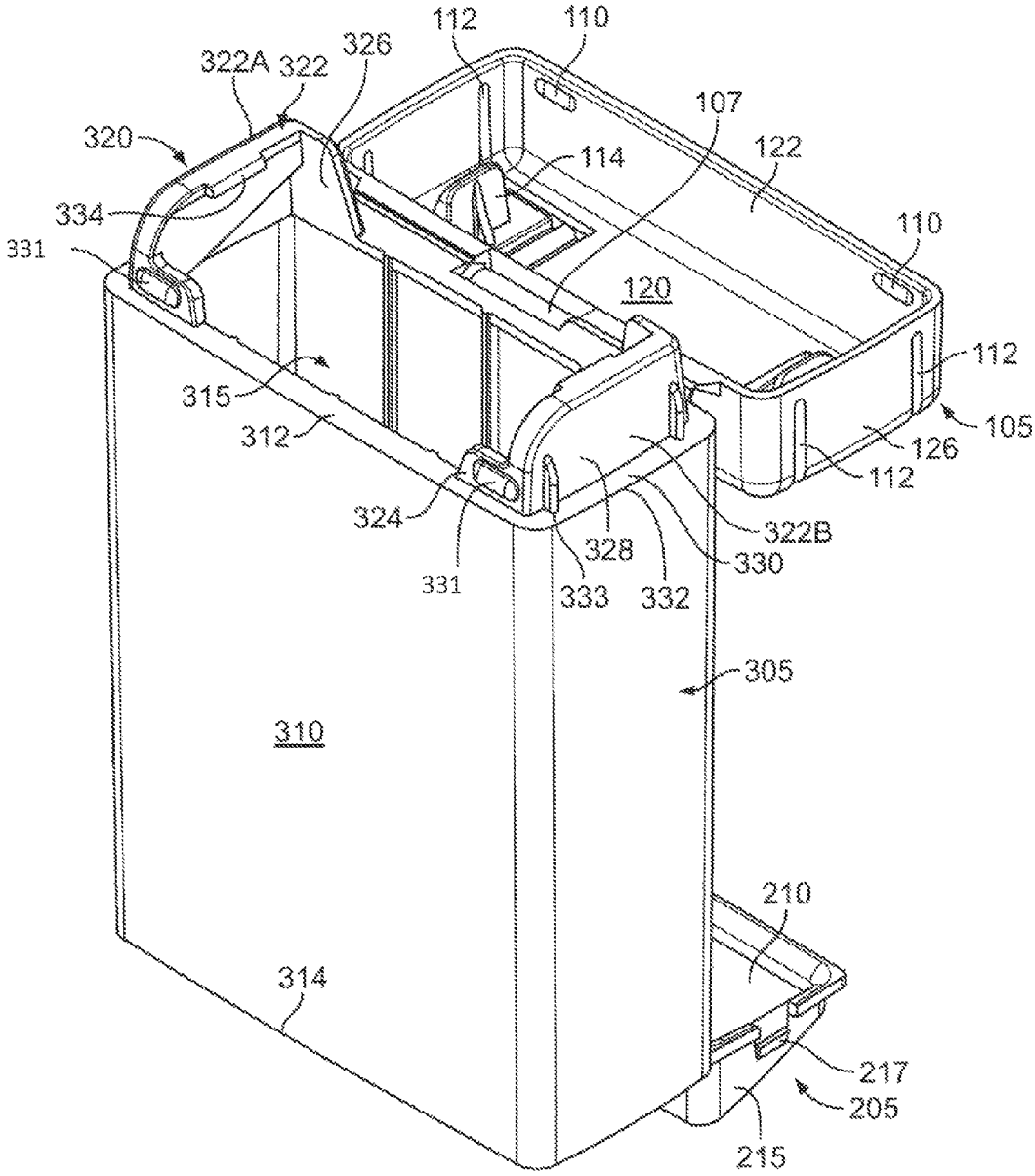
FIG. 2 is a perspective view of FIG. 1 illustrating an opened top and bottom.
Figure 3:
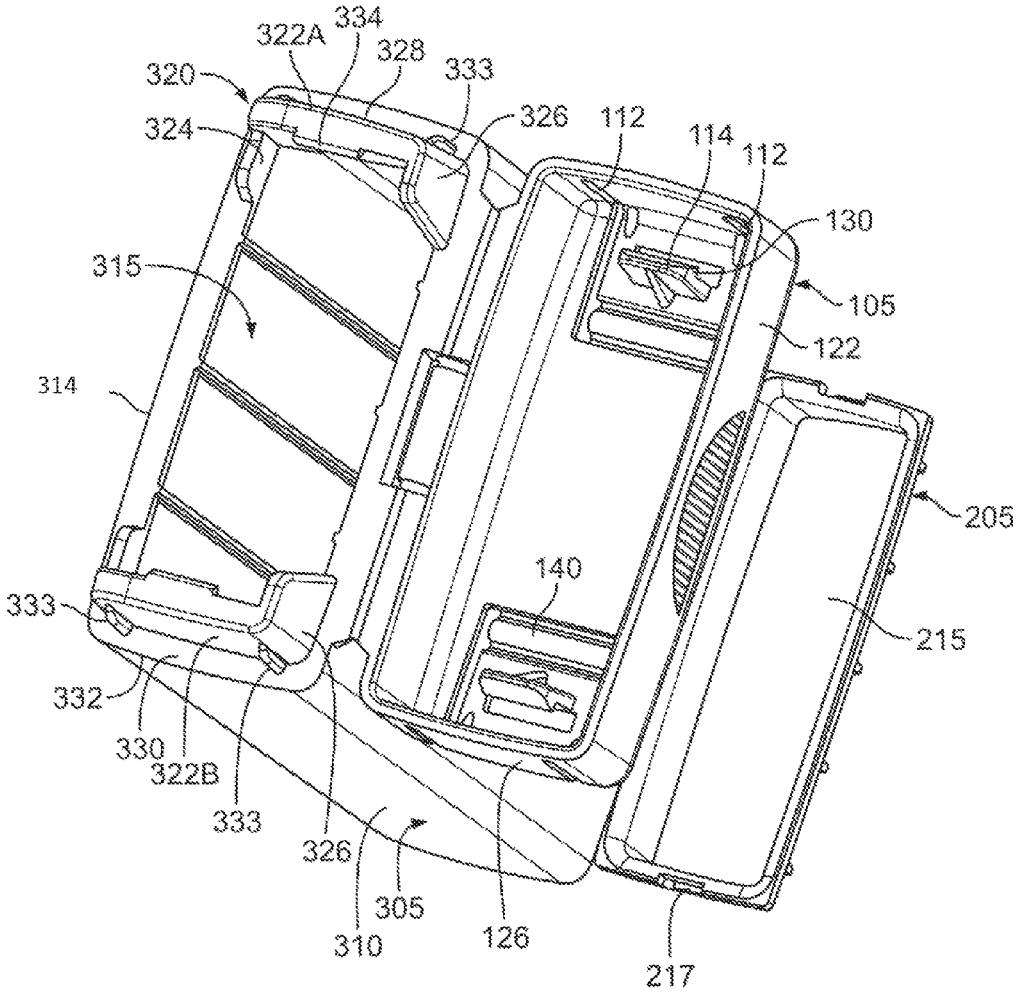
FIG. 3 is a top perspective view of the container from FIG. 1.
Figure 4:
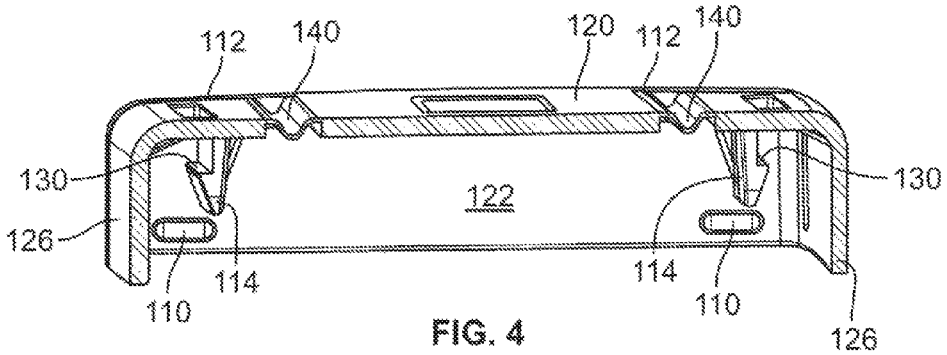
FIG. 4 is a cross section view of the top used in accordance with the container for one embodiment of the present invention.
Figure 5:
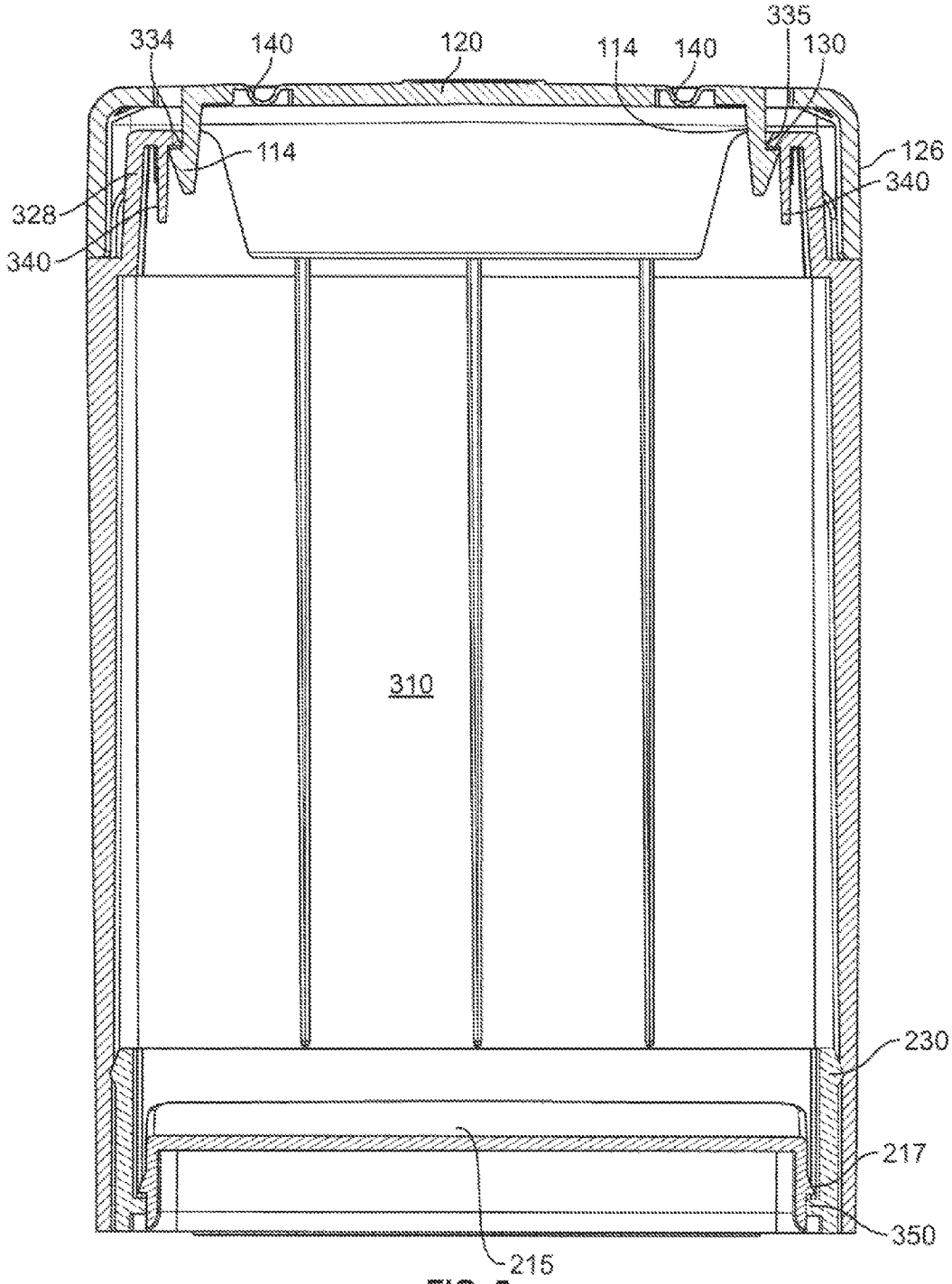
FIG. 5 is a cross sectional view of the container from FIG. 1.
Figure 7:
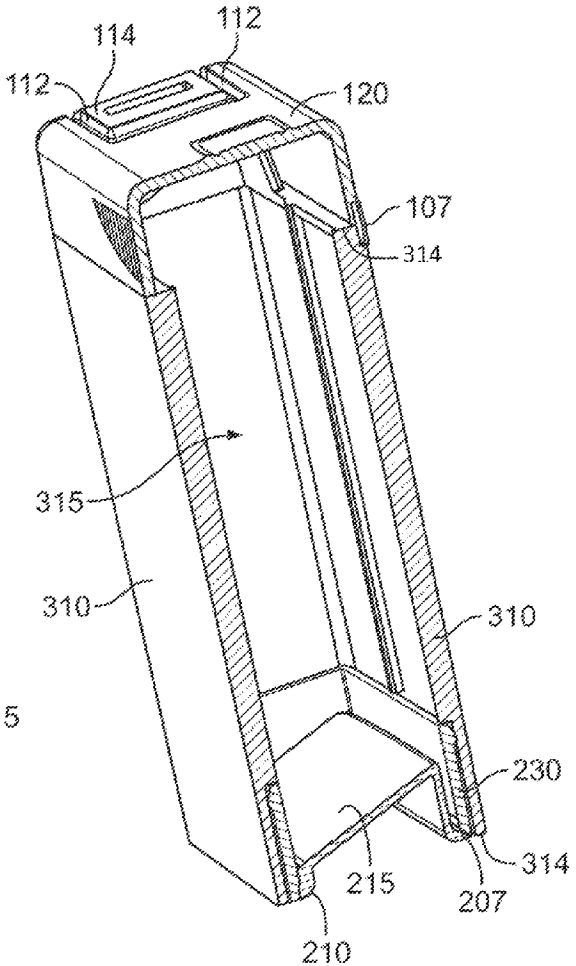
FIG. 7 is a side cross section view of the container from FIG. 1.
Figure 6:
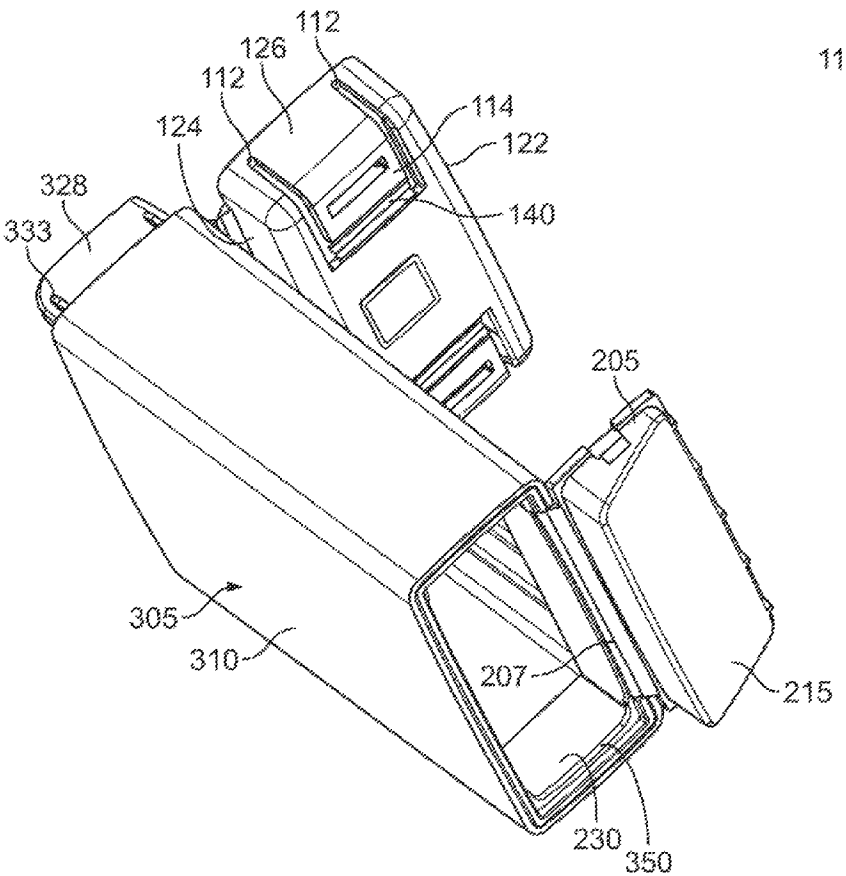
FIG. 6 is a perspective view of the container from the bottom perspective.

Referring now to FIGS. 1 through 7 there is shown in a first embodiment a box type container holder 100 used to hold medication blister cards. The blister cards are well known in the industry and are not shown in the present illustrations, but a simply cards that have pills secured to the cards by blister plastic packaging that permit a user to remove a pill as needed or prescribed. The container holder 100 is designed to aid the user in holder and disbursement of the pills. The container holder 100 may be viewed as having three components that may all be integrally molded or separable and secured or attached to each other to form the holder 100.

The three components are a top or cap 105, a bottom 205 and a central structure 305 positioned between the cap 105 and bottom 205. The central structure 305 has a continuous walled surface 310 extending from a lower edge 312 to an upper edge 314 created a hollowed interior 315 there between, that is configured to hold the medication cards.

Connected to the upper edge 314 of the walled surface 310 is a closure structure 320 that is configured to maintain the cap 105 in a closed position relative the upper edge 314 of the walled surface 310. The closure structure 320 includes a pair of skirts 322 depending upwardly from the upper edge 314 and on either side of the walled surface 310 such that one of the skirts 322A is at a distal end with respect to the other skirt 322B. Each skirt 322 as a forward facing surface 324 and a rearward facing surface 326 that are connected to each other by a side facing surface 328. The three surfaces are inwardly placed along the upper edge 314 such that a lip 330 is formed between the outside terminus 332 of the walled surface 310 and the three surfaces.

Each of the forward facing surfaces 324 contain a detent 331 that correspond to and are configured to engage a slot 110 on the cap 105. When the cap 105 is closed, the detent 131 snaps into the slot 110 to help maintain the cap in a closed position. Other similar corresponding engagement structures may be used for example beads may be used that place one bead below the other bead for a frictional fit.

Each of the side facing surfaces 328 includes protruding horizontal flanges 333 that correspond to and are configured to fit within recesses or channels 112 on the cap 105. In addition, the side facing surfaces 328 include an inwardly extending lateral flange 334 that correspond to and are configured to engage locking members 114 extending from the cap 105. Extending downwardly between the terminal end 335 of the inwardly extending lateral flange 334 and the side facing surface 328 is an intermediate flange 340.

The cap 105 is attached to a portion of the upper edge 314 by a hinge 107. The hinge 107 may be a living hinge or a hinge structure, well known in the industry. The hinge 107 is configured to pivot or move the cap 105 from opened and dosed positions. The cap 105 has a top surface 120 with downwardly engaging forming a front facing wall 122, a rear facing wall 124, and a pair of side walls 126. The front facing wall 122 includes the pair of slots 110 to engage the corresponding detents 330 on the forward facing surfaces 324 closure structure 320. The rear facing wall 124 includes the edge that is hinged to the upper edge 314 of the walled surface 310.

Depending from the top surface 120 are the locking members 114. Each locking member 114 includes an outwardly turned lip 130 configured to engage the inwardly extending lateral flange 334. The locking members 114 are rigidly constructed such that when the cap 105 is closed the container 100 maintains a closed configuration unless opened. The lip 130 on the locking member 114 is positioned against the inwardly extending lateral flange 334 and the intermediate downwardly extending flange 340 to aid in maintaining a closed and sealed interior environment for the medication cards.

The recesses 112 are actually a pair of channels recesses 112 positioned along a portion of the top surface 120 and down the side walls 126. The recesses in the pair are positioned on either side of the locking members 114. The locking members 114 are further connected to the top surface 120 by a bowed thinned walled section 140. To open the cap 105, the user presses inwardly along the edge of side walls 126 between the recesses 112. The bowed thinned walled section 140 compresses to allow the locking member 114 and especially the lip 130 to shift or move out of engagement with the inwardly extending lateral flange 334. Once out of engagement, the cap 105 can open by pulling and disengaging the detents 330 from the slots 110.

The bottom 205 is attached to a portion of the lower edge 312 by a hinge 207. The hinge 207 may be a living hinge or a hinge structure, well known in the industry. The bottom 205 includes a base 210 with a ramp structure 215 extending away from the base 210 and positioned to fit within the hollowed interior 315 of the central structure 305. The ramp structure 215 may be further provided with clips 217 on one or more sides of the structure 215 configured to secure against an edge 350 inwardly extending from the hollowed interior 315. The ramp structure 215 helps stagger the height of the medication cards when resting thereon.

In another aspect the bottom 205 may further include a plug portion 230 designed to be inserted into and secured within a bottom portion of the hollowed interior 315 of the central structure 305. The plug portion includes the edge 350 configured to secure the clips and thus the ramp structure within the plug portion.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended drawings provided, all such modifications within the scope of the invention.

We claim:

1. A pill blister pack container for holding a pill blister pack, the container comprising:

a central structure having an upper portion and a lower portion, a continuous walled surface extending from the lower portion to the upper portion forming a hollowed interior there between, the interior being configured to hold a blister pack;

a top secured to the upper portion of the central structure by a hinge member, the top having a top surface having walls extending downwardly to form a front facing wall, a rear facing wall, and a pair of side walls;

a bottom secured to the lower portion;

a closure structure secured to the upper portion of the central structure configured to maintain the top in a closed portioned, the closure structure includes a pair of skirts depending upwardly from the upper portion and being separately positioned on either side of the walled surface such that one of the pair of skirts is at a distal end with respect to the other skirt, and wherein each skirt has a forward facing surface, a rearward facing surface and a side facing surface connecting the forward and rearward facing surfaces, corresponding first locking members formed on the forward facing surfaces and formed on the top cooperating to maintain the cap in the closed position; and corresponding second locking members formed on the side facing surfaces and formed on the top further cooperating to maintain the cap in the closed positioned, and wherein the second locking members each include a lateral flange inwardly extending from each of the side facing surfaces, the lateral flanges corresponding to and configured to engage locking tabs extending downwardly from the top surface, each locking tabs includes an outwardly turned lip configured to engage the inwardly extending lateral flange, and wherein the top further includes a pair of top recesses positioned along a portion of the top surface and extending down a portion of the side walls, the pair of recesses being separately formed on either side of each locking tab and the locking tabs being connected to the top surface between the pair of recesses by at least by a thinned walled section configured to flex when an exterior force is applied inwardly on the locking tabs, such that the lip on the locking tabs disengages the inwardly extending lateral flange when an exterior force is applied causes the top to move from a closed position to an open position.

2. The container of claim 1, wherein the first locking member includes a detent on the forward facing surfaces corresponding to an indent on the front facing wall.

3. The container of claim 1, further comprising an intermediate flange extending downwardly from an inwardly extending lateral flange and being positioned between a terminal free edge of the inwardly extending lateral flange and the side facing surface.

4. The container of claim 1, wherein the bottom includes:

a plug portion configured to insert within the bottom portion of the hollowed interior of the central structure, and a base having a ramp structure and an edge hingedly attached to an edge of the plug portion, such that the base may be inserted into the plug portion with the ramp structure being positioned in the hollowed interior of the central structure.

5. The container of a claim 1, wherein the forward, rearward, and side facing surfaces are positioned inwardly along the upper portion to form a lip between an outside terminus of the walled surface and the forward, rearward, and side facing surfaces.

6. A pill blister pack container for holding a pill blister pack, the container comprising:

a central structure having an upper portion and a lower portion, a continuous walled surface extending from the lower portion to the upper portion forming a hollowed interior there between, the interior being configured to hold a blister pack;

a top secured to the upper portion of the central structure by a hinge member, and wherein the top includes a top surface having downwardly engaging walls forming a front facing wall, a rear facing wall, and a pair of side walls;

a bottom secured to the lower portion, the bottom having a ramp structure configured within the hollowed interior;

a closure structure secured to the upper portion of the central structure configured to maintain the top in a closed portioned, the closure structure includes a pair of skirts depending upwardly from the upper portion and being separately positioned on either side of the walled surface such that one of the pair of skirts is at a distal end with respect to the other skirt, and wherein each skirt has a forward facing surface, a rearward facing surface and a side facing surface connecting the forward and rearward facing surfaces, and corresponding first locking members formed on the forward facing surfaces and formed on the top cooperating to maintain the cap in the closed position; and corresponding second locking members formed on the side facing surfaces and formed on the top further cooperating to maintain the cap in the closed positioned, wherein the second locking members includes a lateral flange inwardly extending from each of the side facing surfaces, the lateral flanges corresponding to and configured to engage locking tabs extending downwardly from the top surface, each locking tabs includes an outwardly turned lip configured to engage the inwardly extending lateral flange, and wherein the top further includes a pair of recesses positioned along a portion of the top surface and extending down a portion of the side walls and the pair of recesses being separately formed on either side of each locking tab, and the locking tabs being connected to the top surface between the pair of recesses by at least by a bowed thinned walled section configured to flex when an exterior force is applied inwardly on the locking tabs, such that the lip on the locking tabs disengages the inwardly extending lateral flange.

7. The container of claim 6, wherein the first locking members include a detent on the forward facing surfaces corresponding to an indent on the front facing wall.

8. The container of claim 6 further comprising an intermediate flange extending downwardly from an inwardly extending lateral flange and being positioned between a terminal free edge of the inwardly extending lateral flange and the side facing surface.

9. The container of claim 6, wherein the bottom includes:

a plug portion configured to insert within the bottom portion of the hollowed interior of the central structure, and wherein the ramp structure is positioned on a base that is hingedly attached to an edge of the plug portion, such that the base may be inserted into the plug portion with the ramp structure being positioned in the hollowed interior of the central structure.

* * * * *